US005271561A

United States Patent [19]

Tobias et al.

[11] Patent Number: 5,271,561

[45] Date of Patent: Dec. 21, 1993

[54] ROTARY JET HYDROTHERAPY DEVICE AND METHOD

[75] Inventors: Samuel Tobias, Warren; Robert M. Messinger, Cranford; Donald R. Davidson, Chatham, all of N.J.

[73] Assignee: Hayward Industries, Inc., Elizabeth, N.J.

[21] Appl. No.: 907,708

[22] Filed: Jul. 2, 1992

[51] Int. Cl.[5] ..... B05B 15/06; A61H 33/02

[52] U.S. Cl. ..... 239/289; 239/391; 239/600; 4/541.6

[58] Field of Search ..... 239/289, 390, 391, 428.5, 239/600; 4/541.6

[56] References Cited

U.S. PATENT DOCUMENTS

| | | | |
|---|---|---|---|
| 1,101,804 | 6/1914 | Lauter . | |
| 3,868,949 | 3/1975 | Arneson . | |
| 3,985,303 | 10/1976 | Steimle . | |
| 4,220,145 | 9/1980 | Stamp et al. . | |
| 4,221,336 | 9/1980 | Diamond | 239/600 X |
| 4,241,464 | 12/1980 | Buckwalter . | |
| 4,508,665 | 4/1985 | Spinnett . | |
| 4,542,853 | 9/1985 | Diamond . | |
| 4,559,653 | 12/1985 | Mathews . | |
| 4,586,204 | 5/1986 | Daniels | 239/600 X |
| 4,790,481 | 12/1988 | Ray et al. | 239/600 X |
| 4,941,217 | 7/1990 | Tobias et al. . | |
| 4,965,893 | 10/1990 | Henkin et al. . | |
| 4,972,531 | 11/1990 | Gravatt | 239/600 X |
| 4,982,459 | 1/1991 | Henkin et al. | 4/541.6 X |
| 4,985,943 | 1/1991 | Tobias et al. . | |
| 5,014,372 | 5/1991 | Thrasher et al. | 239/428.5 X |
| 5,076,500 | 12/1991 | Daniels | 239/600 X |

*Primary Examiner*—Andres Kashnikow
*Assistant Examiner*—William Grant
*Attorney, Agent, or Firm*—Ralph W. Selitto, Jr.

[57] ABSTRACT

An outlet assembly for a water receptacle, such as a swimming pool, spa or the like, includes a pair of interchangeable discharge nozzles, one being a rotary discharge nozzle and the other being a linear discharge nozzle. A user may selectively interchange the rotary discharge nozzle and the linear discharge nozzle by withdrawing and inserting them through an outlet port sized and shaped so as to permit the user's hand to fit therein.

32 Claims, 4 Drawing Sheets

ROTARY JET HYDROTHERAPY DEVICE AND METHOD

FIELD OF THE INVENTION

The present invention relates to a discharge jet which may be used, e.g., to discharge water and air into a spa, swimming pool, or the like, and, more particularly, to a jet with a rotatable nozzle having a plurality of outlets which rotates in response to the discharge flow.

DESCRIPTION OF THE PRIOR ART

The prior art is replete with a variety of discharge nozzles and outlets for discharging water and/or air. Certain of these nozzles and outlets have been employed for mixing and admitting water and air into pools and spas. Typically, this is accomplished by providing separate supplies of air and water via discrete conduits to a nozzle or outlet body which has passages therein adapted to conduct the air and water into a mixing chamber and then discharge the mixture through a discharge outlet into the pool or spa. The water is usually supplied under pressure and the air may also be pressurized. However, air may also be entrained into the discharge flow via a pressure differential due to the Bournoulli principle.

U.S. Pat. No. 4,985,943 to Tobias, et al. and assigned to the assignee herein is an example of one unique type of outlet jet (i.e., an adjustable jet having three nozzles). In U.S. Pat. No. 4,985,943, a first nozzle discharges pressurized water into a mixing chamber communicating with a source of air which is entrained into the flow of pressurized water due to the venturi effect and the mixture is discharged through a second nozzle into a second mixing chamber. The mixture of air and water is discharged through a third nozzle creating a pressure differential within the second mixing chamber that entrains water from the primary pool or spa reservoir into the discharge flow.

Besides having recognized that a forcible discharge of fluid/air into a pool or spa can produce a pleasant and therapeutic effect upon the user upon whom it impinges, it has also been recognized that a flow which has a varying direction can enhance this beneficial effect. Accordingly, a variety of devices have been proposed for creating this changing flow pattern. For example, U.S. Pat. No. 4,965,893 to Henkin et al. discloses a hydrotherapy massage method and apparatus employing a rotatable, rigid, elongated conduit that swivels and moves in reaction to a discharge stream. U.S. Pat. No. 3,868,949 to Arneson and assigned to the assignee herein, discloses a rotatable discharge having a rotatable disk with at least one water outlet delivering an outlet stream in a direction which results in a torque that rotates the disk during discharge.

Despite the existence of the above-described devices and methods for producing fluid discharges suitable for use in pools, spas and the like, there still remains a desire and need to improve upon these devices and methods to yield designs and methods which are more effective, reliable and inexpensive. It is therefore an object of the present invention to provide such a device and method.

SUMMARY OF THE INVENTION

The problems and disadvantages associated with the conventional techniques and devices utilized to create therapeutic flows and currents in hydrotherapeutic reservoirs are overcome by the present invention which utilized a new and improved outlet assembly including a pair of interchangeable discharge nozzles, one being a rotary discharge nozzle and the other being a linear discharge nozzle. A user may selectively interchange the rotary discharge nozzle and the linear discharge nozzle by withdrawing and inserting them through an outlet port sized and shaped so as to permit the user's hand to fit therein. The linear discharge nozzle is spaced from an associated bulkhead fitting a distance sufficient to maintain the outlet port open and accessible, whereby the user can replace the linear discharge nozzle with the rotary discharge nozzle without disassembling the bulkhead fitting.

BRIEF DESCRIPTION OF THE FIGURES

For a better understanding of the present invention, reference is made to the following detailed description of an exemplary embodiment considered in conjunction with the accompanying drawings, in which.

DESCRIPTION OF THE EXEMPLARY EMBODIMENTS

Figure 1:
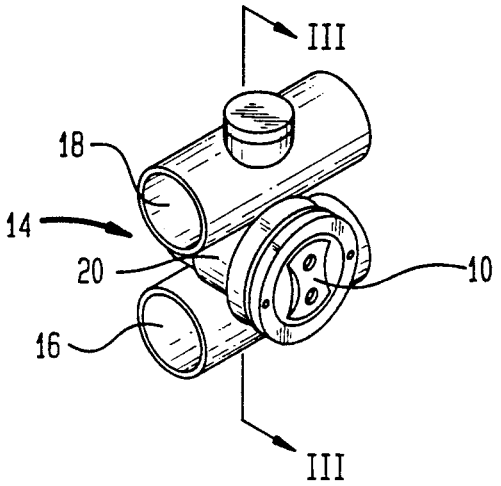
FIG. 1 PRIOR ART
FIG. 1 is a perspective view of a prior art device.

FIG. 1 shows a a rotary jet discharge outlet 10 installed in an outlet conduit 12 of a jet body 14. The body 14 has a water conduit 16, an air conduit 18 and a centrally disposed mixing and discharge portion 20 housing a plurality of communicating concentric chambers and terminating in the outlet conduit 12.

Figure 2:
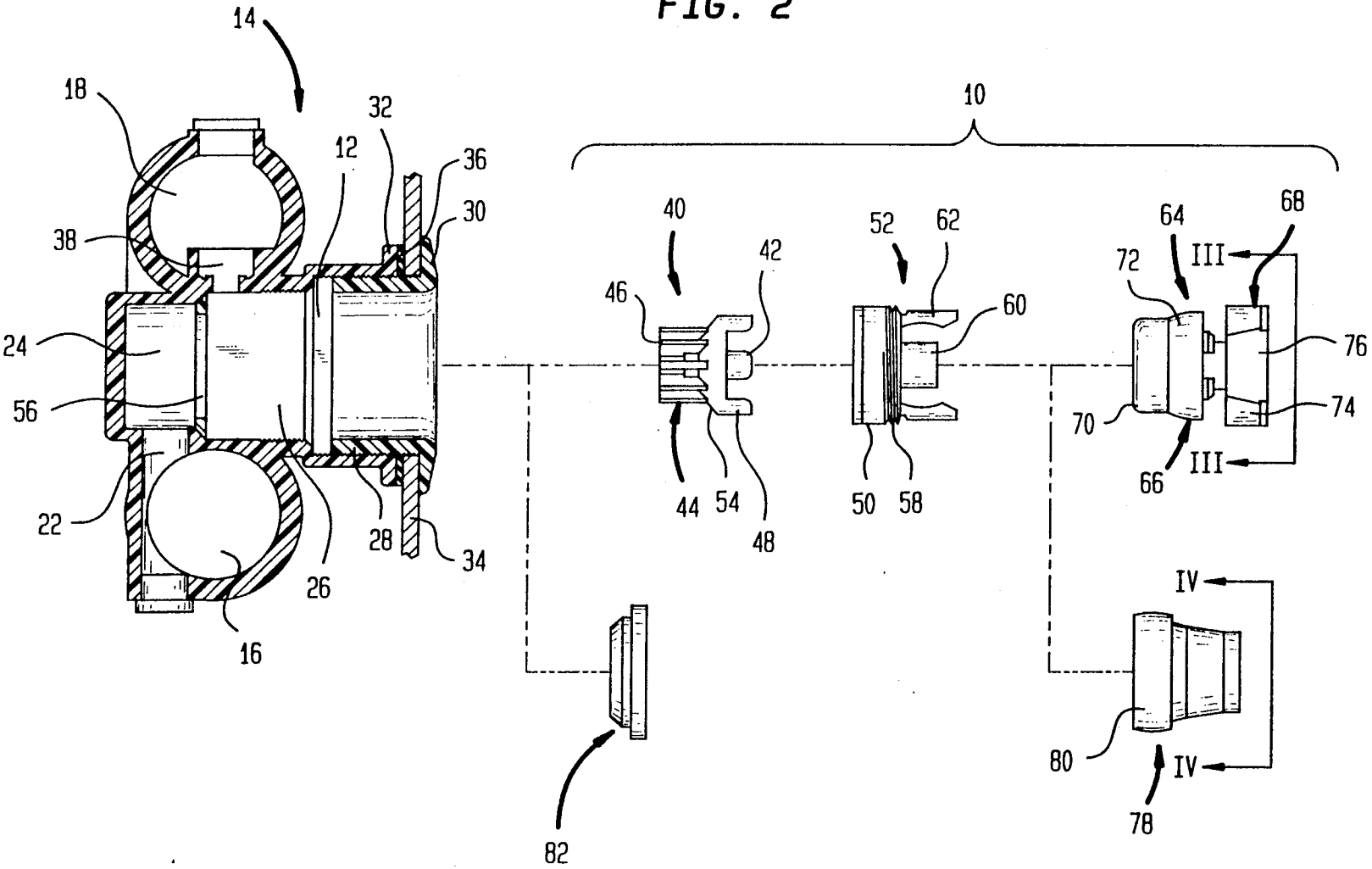
FIG. 2 is an exploded, partially cross-sectional view of an outlet assembly constructed in accordance with the present invention.

Referring now to FIG. 2, it can be seen that the jet body 14 has a passageway 22 between water conduit 16 and a first chamber 24. Chamber 24 opens into a larger, concentric chamber 26 which then discharges into the discharge conduit 12. The discharge conduit 12 has internal threads for receiving a mating hollow threaded fitting 28 having a flange 30 which, in cooperation with a flange 32 formed on the discharge conduit 12, captures a pool or spa wall 34 therebetween. A gasket 36 may be provided for an enhanced seal. An air passage 38 communicates between the air conduit 18 and the chamber 26, which is also internally threaded proximate to the discharge conduit 12.

A first stage 40 of the outlet 10 includes a water nozzle 42 through which water entering the chamber 24 is dispensed. The first stage 40 has a diffuser 44 composed of a plurality of fins 46 adapted to diffuse any vortex set up in water conducted through the passageway 22 prior to its entry into the nozzle 42. Vortex flows disturb the rotary motion of the outlet as shall become apparent after considering the invention in its entirety. The first stage 40 employs at least two and preferably four or more gripping arms 48 which grip a suitable groove 50 or other indentation provided in a second stage 52, yielding a substantially rigid assembly. Only two arms 48 have been depicted to permit a view of the nozzle 42. It should be observed that the first stage 40 is sized to permit an annular, exterior, tapered surface 54 to seal against a suitable gasket 56 provided at the upper peripheral edge of the chamber 24. Thus, pressurized water must flow through the nozzle 42 in order to proceed on to the second stage 52.

The second stage 52 has external threads 58 for securing it within the chamber 26 and includes a second nozzle 60 and retainer arms 62 for gripping a third stage 64. Prior to assembling the third stage 64 to the second stage 52, the first and second stages 40 and 52 may be assembled and screwed into the central portion 20 such that the chamber 24 is sealed, as discussed above, and the arms 48 and the nozzle 42 are generally disposed within the chamber 26. The second stage seals the chamber 26 such that the contents thereof can only discharge through the nozzle 60.

Given a supply of pressurized water to the conduit 16 and supply of air provided to the conduit 18, the water will pass through the diffuser 44 and the nozzle 42. In its passage through the nozzle 42, the water creates an area of low pressure within the chamber 26, thereby entraining air admitted into the chamber 26 through the passage 38. The air/water mixture is then propelled through the nozzle 60.

As can be seen in FIG. 2, the third stage 64 has a rear section 66 and a front section 68. The rear section 66 has a straight cylindrical portion 70 and a bulbous, spheric section 72, which is accommodated within the mating, spheric inner configuration of the arms 62. The arms 62 would typically be an injection molding of a deformable resilient thermoplastic material, and, thus, they would exhibit elastic memory and removably grip the bulbous portion 72. The front portion 68 includes the rotatable nozzle 74. The rotatable nozzle 74 has reliefs 76 therein to permit gripping with the fingers to remove and replace the third stage 64 from the second stage 52, even when the second stage 52 is in place within the outlet conduit 12.

The present invention also includes a non-rotating replacement nozzle 78 having a bulbous end 80 which can be retained by the arms 62 of the second stage 52. Thus, if a user would prefer to have a constant, rather than varying, flow pattern, the third stage 64 may be removed and replaced with the nozzle 78. In this configuration, the present invention constitutes a device having attributes like the device shown and described in U.S. Pat. No. 4,985,943, the specification of which is incorporated herein by reference.

Another aspect of the present invention is an annular adapter seat 82, which can be used in lieu of the gasket 56. The dimensions of the seat 82 can be selected so as to permit the use of the discharge outlet 10 in various different jet bodies.

Figure 3:
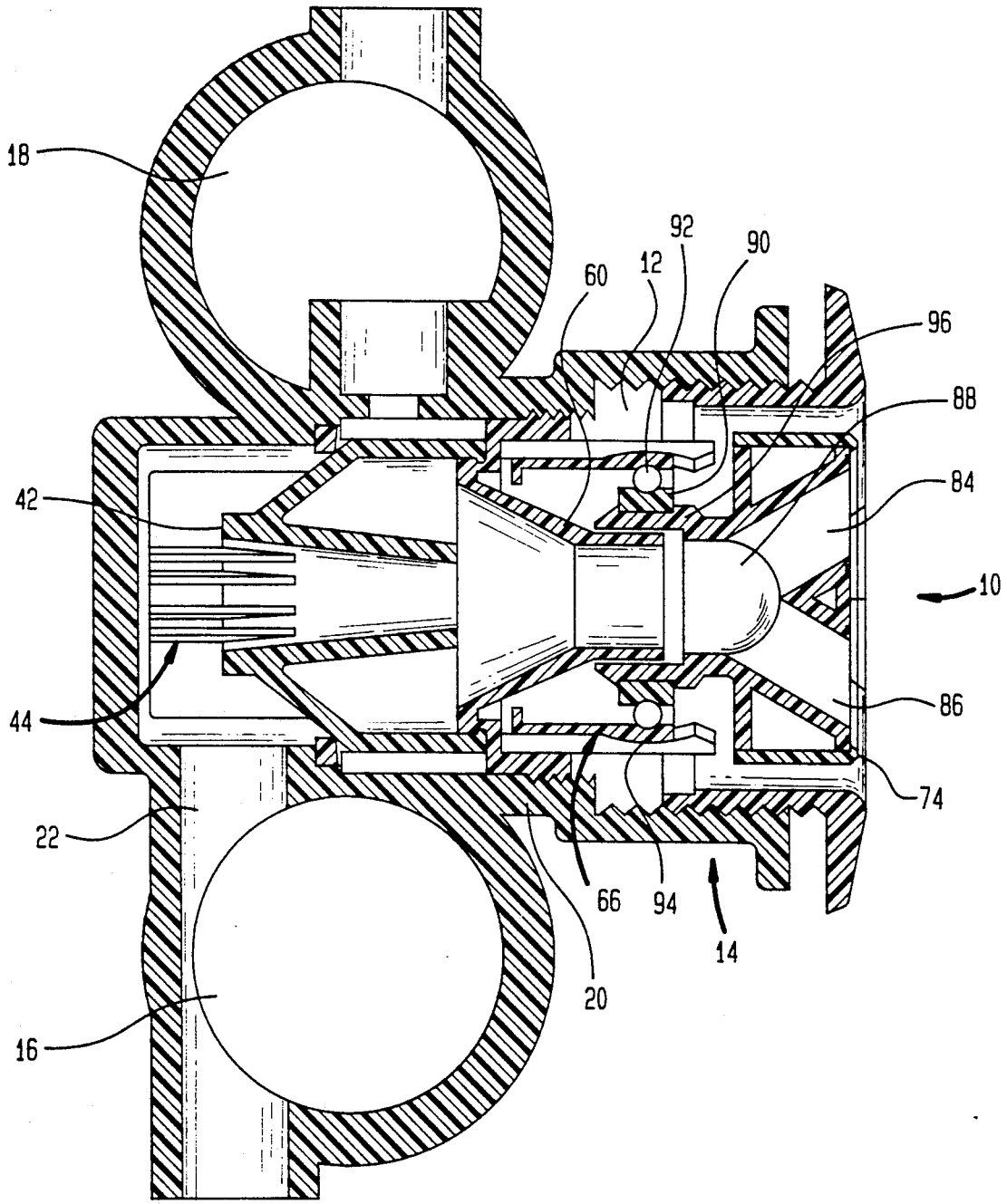
FIG. 3 (PRIOR ART)
FIG. 3 is a detailed, cross-sectional view taken along section lines III—III in FIGS. 1 and 2, of the prior art device shown in FIG. 1.

FIG. 3 shows the rotary jet discharge outlet 10 in position within the outlet conduit 12 of the central portion 20 of the body 14. Interior bores 84 and 86 extend through the rotatable nozzle 74, emanating from a common internal port 88. Thus, the bores 84 and 86 divide the flow from the nozzle 60 into two portions. The axes of the ports 84, 86 are skewed such that at least some component of the reactive force from the discharge of pressurized water induces rotation of the nozzle 74 in a given arcuate direction. The rotatable nozzle 74 is carried by a ball bearing having an inner race 90, balls 92 and an outer race 94. The outer race 94 may be monolithically formed within the rear section 66, as shown.

The cylindrical portion 70 of the rear section 66 preferably terminates in an inwardly directed lip disposed perpendicularly with respect to the walls of the cylindrical portion 70 such that the rear section 66 of the third stage 64 can not fit between the arms 62 and the inner surface of the outlet conduit 12. This "no-fit" condition facilitates assembly of the third stage 64 to the second stage 52, especially when it is installed in a pool or spa below the water line.

In the embodiment shown, the rotatable nozzle 74 is retained in association with the inner race 90 via a snap fit of extensions 96 therein. It is preferred that the inner peripheral space between the extensions 96 be dimensioned to provide a small mechanical clearance between the extensions 96 and the outer peripheral surface of the nozzle 60. If the aforesaid clearance is small enough, the extensions 96 do not have sufficient freedom of movement to permit the removal of the nozzle 74 from the inner race 90. As a result, the third stage 64 retains its integrity during removal/detachment from the second stage 52. Once the third stage 64 is disconnected from the second stage 52, the rotatable nozzle 74 can be easily disengaged from the inner race 90 to permit bearing replacement.

In the embodiment depicted in FIG. 3, it should be observed that the diffuser 44 is located within the nozzle 42. The preferred alternative, however, is for the fins 46 to extend inwardly and outwardly with respect to the nozzle 42.

Figure 4:
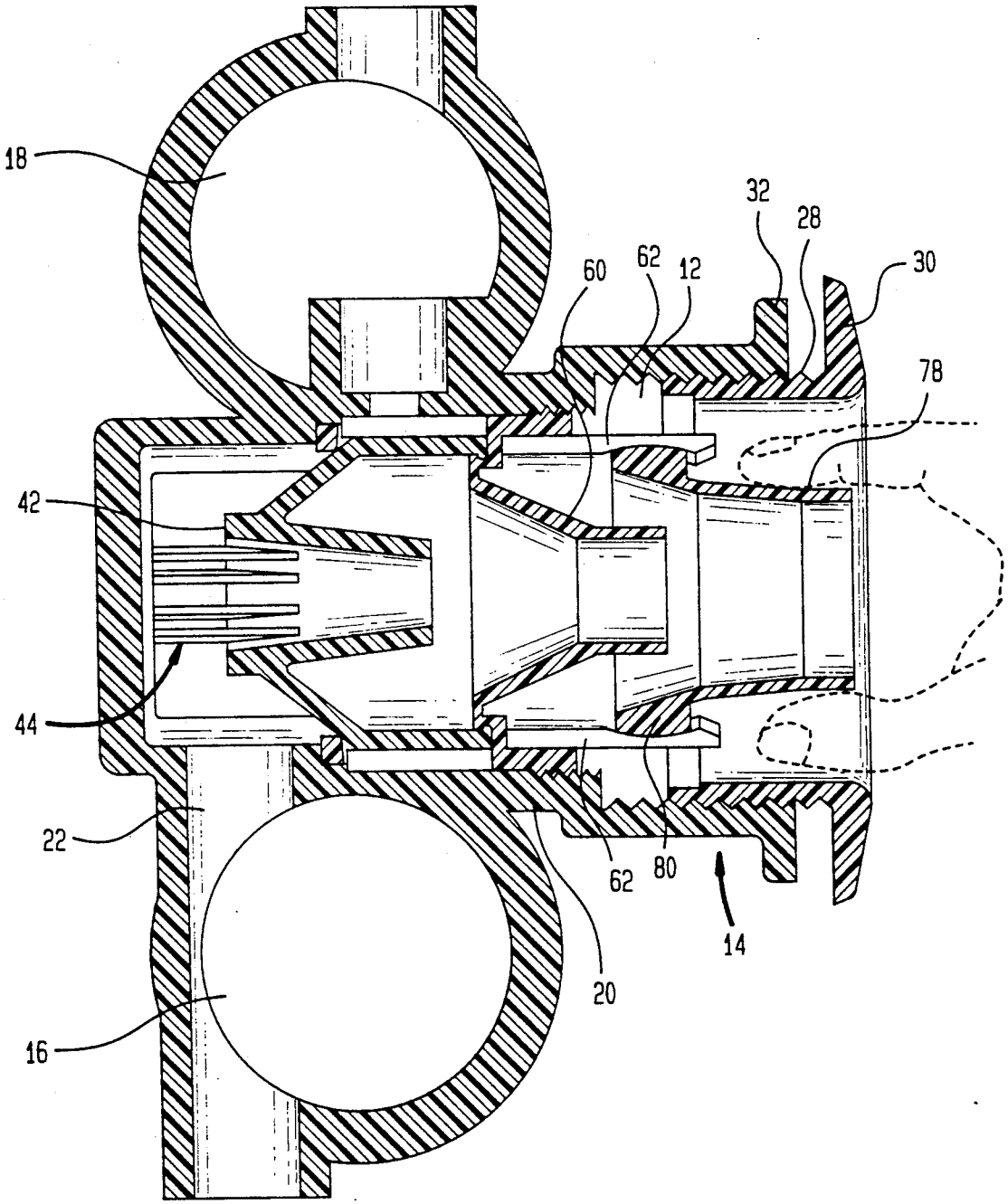
FIG. 4 is a detailed, cross-sectional view taken along section line IV—IV in FIG. 2, of the outlet assembly of the present invention equipped with a linear discharge nozzle.

FIG. 4 shows the jet body 14 equipped with the non-rotating nozzle 78 assembled to the second stage 52 in lieu of the third stage 64, which has been removed. As can be seen, the bulbous portion 80 of the nozzle 78 is slideably embraced by the arms 62 such that the nozzle 78 can be pivoted and directed as desired by the user. The nozzle 78 is surrounded by the fitting 28, which has an outlet port sized and shaped so as to permit the user's hand (shown in phantom by the broken lines) to extend into the open space between the fitting 28 and the nozzle 78 and then grip the nozzle 78 in the manner depicted in FIG. 4.

Figure 5:
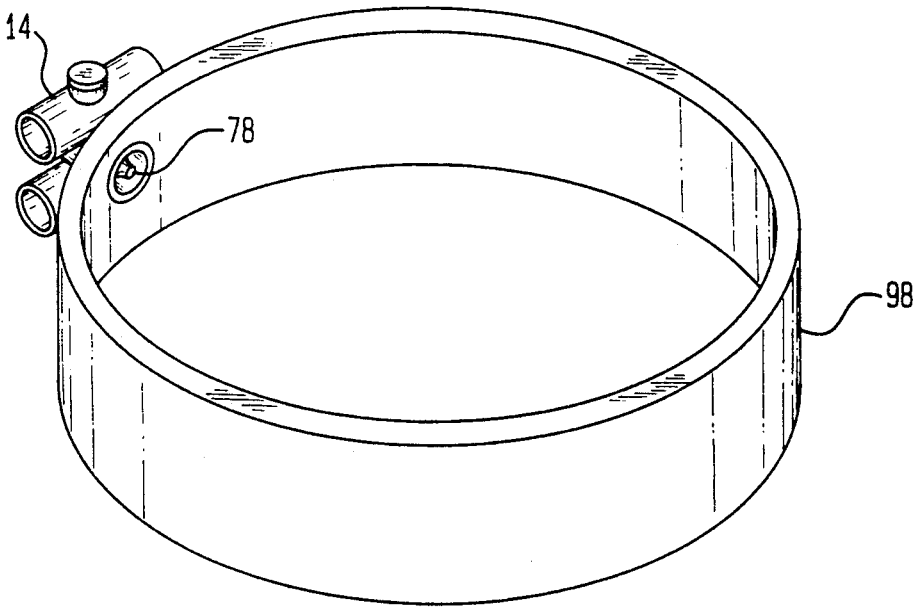
FIG. 5 is a schematic illustration of the outlet assembly of FIG. 4 mounted in a water receptacle, such as a swimming pool or spa.

FIG. 5 shows the jet body 14 equipped with the non-rotating nozzle 78 and mounted in a water receptacle 98. As indicated above, the water receptacle 98 can be a swimming pool, spa, or the like.

It should be understood that the embodiments described herein are merely exemplary and that a person skilled in the art may make many variations and modifications without departing from the spirit and scope of the invention as defined in the appended claims.

We claim:

1. An outlet assembly for a water receptacle, comprising a housing mounted outside the water receptacle; a bulkhead fitting mounted inside the water receptacle and attached to said housing through an opening provided in a wall of the water receptacle, said bulkhead fitting having an outlet port sized and shaped so as to permit a user's hand to fit therein; and retaining means mounted in and to said housing for retaining one of a pair of discharge nozzles within said housing, said pair of discharge nozzles including a rotary discharge nozzle, said rotary discharge nozzle having first mating means for mating with said retaining means so as to releasably retain said rotary discharge nozzle within said housing, and a linear discharge nozzle, said linear discharge nozzle having second mating means for mating with said retaining means so as to releasably retain said linear discharge nozzle within said housing when said first mating means has been disengaged from said retaining means and when said rotary discharge nozzle has been removed from said housing, whereby a user may selectively interchange said linear discharge nozzle and said rotary discharge nozzle by withdrawing and inserting them through said outlet port, said retaining means including a plurality of flexible retainer arms, said retainer arms cooperating with said second mating means to freely and pivotally suspend said linear discharge nozzle within said housing such that said linear discharge nozzle is spaced from said bulkhead fitting a distance sufficient to maintain said outlet port open and accessible, whereby a user can replace said linear discharge nozzle with said rotary discharge nozzle without disassembling said bulkhead fitting.

2. An outlet assembly according to claim 1, further comprising a first stage nozzle mounted in said housing upstream from said one of said pair of discharge nozzles; and a second stage nozzle mounted in said housing between said first stage nozzle and said one of said pair of discharge nozzles.

3. An outlet assembly according to claim 2, further comprising an annular adapter removably received within said housing between an internal shoulder and said first stage nozzle, said adapter having a sealing surface sized and shaped so as to form a liquid-tight seal between a water inlet of said housing and an air inlet of said housing, a seating surface sized and shaped so as to form a seat for said first stage nozzle, and an outer peripheral surface sized and shaped so as to match an internal peripheral surface of said housing.

4. An outlet assembly according to claim 3, wherein said adapter is interchangeable with an annular gasket having an outer peripheral surface with a size and shape different from those of said outer peripheral surface of said adapter, whereby said outlet assembly can accommodate various different housings by selectively employing one of said adapter and said gasket.

5. An outlet assembly according to claim 1, wherein said first mating means includes a curved circumferential surface on said rotary discharge nozzle and said second mating means includes a curved circumferential surface on said linear discharge nozzle, the curvature of said curved circumferential surface of said linear discharge nozzle being substantially identical to the curvature of said curved circumferential surface of said rotary discharge nozzle.

6. An outlet assembly according to claim 5, wherein each of said retainer arms has a curved inner surface sized and shaped so as to match said curved circumferential surfaces of said rotary discharge nozzle and said linear discharge nozzle.

7. An outlet assembly according to claim 6, wherein said curved circumferential surfaces of said rotary discharge nozzle and said linear discharge nozzle are convex.

8. An outlet assembly according to claim 1, wherein said curved inner surfaces of said retainer arms selectively cooperate with said curved circumferential surface of said one of said pair of discharge nozzles to form a ball and socket joint.

9. An outlet assembly according to claim 8, wherein said retainer arms have an elastic memory sufficient to permit said curved inner surfaces thereof to frictionally engage said curved circumferential surface of said linear discharge nozzle such that said linear discharge nozzle can be maintained at various different orientations relative to said outlet port.

10. An outlet assembly according to claim 9, further comprising a first stage nozzle mounted in said housing upstream from said one of said pair of discharge nozzles; and a second stage nozzle mounted in said housing between said first stage nozzle and said one of said pair of discharge nozzles.

11. An outlet assembly according to claim 10, wherein said retainer arms extend outwardly from a mounting ring which extends circumferentially about said second stage nozzle, said retainer arms being spaced from each other and from said second stage nozzle so as to permit water entrained from the water receptacle by fluid discharged from said second stage nozzle to flow between said retainer arms and then enter said one of said pair of discharge nozzles along with the fluid discharged from said second stage nozzle.

12. An outlet assembly according to claim 11, wherein the entrained water is continuously supplied to said linear discharge nozzle when said linear discharge nozzle is mounted in said housing.

13. An outlet assembly according to claim 12, wherein said housing includes a water inlet positioned so as to supply pressurized water to said first stage nozzle and an air inlet positioned so as to allow air to be entrained by water discharged from said first stage nozzle.

14. In combination, a receptacle for water, said receptacle including a wall; a housing mounted outside said water receptacle; a bulkhead fitting mounted inside said water receptacle and attached to said housing through an opening provided in said wall of said water receptacle, said bulkhead fitting having an outlet port sized and shaped so as to permit a user's hand to fit therein; and retaining means mounted in and to said housing for retaining one of a pair of discharge nozzles within said housing, said pair of discharge nozzles including a rotary discharge nozzle, said rotary discharge nozzle having first mating means for mating with said retaining means so as to releasably retain said rotary discharge nozzle within said housing, and a linear discharge nozzle, said linear discharge nozzle having second mating means for mating with said retaining means so as to releasably retain said linear discharge nozzle within said housing when said first mating means has been disengaged from said retaining means and when said rotary discharge nozzle has been removed from said housing, whereby a user may selectively interchange said linear discharge nozzle and said rotary discharge nozzle by withdrawing and inserting them through said outlet port, said retaining means including a plurality of flexible retainer arms, said retainer arms cooperating with said second mating means to freely and pivotally suspend said linear discharge nozzle within said housing such that said linear discharge nozzle is spaced from said bulkhead fitting a distance sufficient to maintain said outlet port open and accessible, whereby a user can replace said linear discharge nozzle with said rotary discharge nozzle without disassembling said bulkhead fitting.

15. A combination according to claim 14, further comprising a first stage nozzle mounted in said housing upstream from said one of said pair of discharge nozzles; and a second stage nozzle mounted in said housing between said first stage nozzle and said one of said pair of discharge nozzles.

16. A combination according to claim 15, further comprising an annular adapter removably received within said housing between an internal shoulder and said first stage nozzle, said adapter having a sealing surface sized and shaped so as to form a liquid-tight seal between a water inlet of said housing and an air inlet of said housing, a seating surface sized and shaped so as to form a seat for said first stage nozzle, and an outer peripheral surface sized and shaped so as to match an internal peripheral surface of said housing.

17. A combination according to claim 16, wherein said adapter is interchangeable with an annular gasket having an outer peripheral surface with a size and shape different from those of said outer peripheral surface of said adapter, whereby said outlet assembly can accommodate various different housings by selectively employing one of said adapter and said gasket.

18. A combination according to claim 14, wherein said first mating means includes a curved circumferential surface on said rotary discharge nozzle and said second mating means includes a curved circumferential surface on said linear discharge nozzle, the curvature of said curved circumferential surface of said linear discharge nozzle being substantially identical to the curvature of said curved circumferential surface of said rotary discharge nozzle.

19. A combination according to claim 12, wherein each of said retainer arms has a curved inner surface sized and shaped so as to match said curved circumferential surfaces of said rotary discharge nozzle and said linear discharge nozzle.

20. A combination according to claim 19, wherein said curved circumferential surfaces of said rotary discharge nozzle and said linear discharge nozzle are convex.

21. A combination according to claim 20, wherein said curved inner surfaces of said retainer arms selectively cooperate with said curved circumferential surface of said one of said pair of discharge nozzles to form a ball and socket joint.

22. A combination according to claim 21, wherein said retainer arms have an elastic memory sufficient to permit said curved inner surfaces thereof to frictionally engage said curved circumferential surface of said linear discharge nozzle such that said linear discharge nozzle can be maintained at various different orientations relative to said outlet port.

23. A combination according to claim 22, further comprising a first stage nozzle mounted in said housing upstream from said one of said pair of discharge nozzles; and a second stage nozzle mounted in said housing between said first stage nozzle and said one of said pair of discharge nozzles.

24. A combination according to claim 23, wherein said retainer arms extend outwardly from a mounting ring which extends circumferentially about said second stage nozzle, said retainer arms being spaced from each other and from said second stage nozzle so as to permit water entrained from the water receptacle by fluid discharged from said second stage nozzle to flow between said retainer arms and then enter said one of said pair of discharge nozzles along with the fluid discharged from said second stage nozzle.

25. A combination according to claim 24, wherein the entrained water is continuously supplied to said linear discharge nozzle when said linear discharge nozzle is mounted in said housing.

26. A combination according to claim 25, wherein said housing includes a water inlet positioned so as to supply pressurized water to said first stage nozzle and an air inlet positioned so as to allow air to be entrained by water discharged from said first stage nozzle.

27. A method for converting an outlet assembly of a water receptacle from a rotary discharge outlet to a linear discharge outlet and vice versa, comprising the steps of:

(a) providing a pair of interchangeable discharge nozzles, said pair of discharge nozzles including a rotary discharge nozzle and a linear discharge nozzle, both of which are engageable by flexible retaining means mounted in and to a housing of said outlet assembly;

(b) engaging one of said discharge nozzles with said flexible retaining means;

(c) removing said one discharge nozzle from said housing by manually pulling on said one discharge nozzle to disengage it from said flexible retaining means and then withdrawing said one discharge nozzle from said housing through an outlet port of an associated bulkhead fitting; and (d) inserting the other discharge nozzle into said housing by passing it through said outlet port and into engagement with said flexible retaining means, both of said steps (c) and (d) being carried out without disassembling said bulkhead fitting.

28. A method according to claim 27, wherein each discharge nozzle of said pair of discharge nozzles is snapped into and out of engagement with said flexible retaining means.

29. A method according to claim 27, further comprising the step of providing a pair of interchangeable sealing members, said pair of sealing members including a first sealing member sized and shaped so as to be removably received within said housing and a second sealing member sized and shaped so as to be removably received within another housing.

30. A method according to claim 29, wherein said one discharge nozzle is said rotary discharge nozzle and said other discharge nozzle is said linear discharge nozzle.

31. A method according to claim 30, wherein said rotary discharge nozzle and said first sealing member are supplied as original equipment with said housing, said method further comprising the step of retrofitting said housing with said linear discharge nozzle.

32. A method according to claim 30, wherein said rotary discharge nozzle is supplied as original equipment with said another housing, said method further comprising the step of retrofitting said another housing with said second sealing member and with said linear discharge nozzle.

* * * * *

UNITED STATES PATENT AND TRADEMARK OFFICE

CERTIFICATE OF CORRECTION

PATENT NO. : 5,271,561

DATED : December 21, 1993

INVENTOR(S) : Tobias et al.

It is certified that error appears in the above-identified patent and that said Letters Patent is hereby corrected as shown below:

Column 7, line 25, delete "12" and insert --18--.

Signed and Sealed this

Twenty-eighth Day of June, 1994

Bruce Lehman

*Attest:*

BRUCE LEHMAN

*Attesting Officer*

*Commissioner of Patents and Trademarks*